US010820660B2

(12) United States Patent
Smith

(10) Patent No.: US 10,820,660 B2
(45) Date of Patent: Nov. 3, 2020

(54) SHOELACE RETAINERS FOR SHOES, AND RELATED METHODS

(71) Applicant: Jeremy Smith, Boulder, CO (US)

(72) Inventor: Jeremy Smith, Boulder, CO (US)

( * ) Notice: Subject to any disclaimer, the term of this patent is extended or adjusted under 35 U.S.C. 154(b) by 0 days.

(21) Appl. No.: 16/174,928

(22) Filed: Oct. 30, 2018

(65) Prior Publication Data

US 2019/0125033 A1 May 2, 2019

Related U.S. Application Data

(60) Provisional application No. 62/579,747, filed on Oct. 31, 2017.

(51) Int. Cl.
*A43C 7/00* (2006.01)
*A43C 7/02* (2006.01)

(52) U.S. Cl.
CPC ..... *A43C 7/02* (2013.01); *A43C 7/00* (2013.01); *A43C 7/005* (2013.01)

(58) Field of Classification Search
CPC .. A43C 7/02; A43C 7/005; A43C 7/04; A43C 7/00; Y10T 24/3708; Y10T 24/3703; Y10T 24/3705; Y10T 24/3713; Y10T 24/3716; Y10T 24/3718
See application file for complete search history.

(56) References Cited

U.S. PATENT DOCUMENTS 2,841,849 A * 7/1958 Rice ..... B65D 85/67 24/712.6
3,122,805 A * 3/1964 Hakim ..... A43C 7/00 24/712.3
5,746,500 A * 5/1998 Chien ..... A43B 1/0036 36/137
8,888,346 B2 * 11/2014 Tseng ..... A43B 3/001 362/103
2016/0081432 A1 * 3/2016 Caron ..... A43C 7/005 36/50.1

* cited by examiner

*Primary Examiner* — Jack W Lavinder
(74) *Attorney, Agent, or Firm* — Harness, Dickey & Pierce, P.L.C.

(57) ABSTRACT

A shoelace retainer is provided for use with a shoe. The shoelace retainer generally includes a base defining at least one channel for receiving a first portion of a shoelace therein while the shoelace is coupled to a shoe, thereby coupling the shoelace retainer to the shoe, and a cap associated with the base and defining at least one receptacle relative to the base where the at least one receptacle is configured to receive a second portion of the shoelace when the base is coupled to the shoe.

16 Claims, 21 Drawing Sheets

SHOELACE RETAINERS FOR SHOES, AND RELATED METHODS

CROSS-REFERENCE TO RELATED APPLICATION

This application claims the benefit of, and priority to, U.S. Provisional Application No. 62/579,747, filed on Oct. 31, 2017. The entire disclosure of the above application is incorporated herein by reference.

FIELD

The present disclosure generally relates to shoelace retainers for shoes, and methods relating thereto.

BACKGROUND

This section provides background information related to the present disclosure which is not necessarily prior art.

Shoelaces are often used to secure shoes to feet of individuals. In connection therewith, the shoelaces are initially threaded through eyelets of the shoes. Then, the shoes are positioned on the feet of the individuals and the shoelaces are tied to secure the shoes to the individuals' feet. Typically, the shoelaces are tied in bow knots in which free ends of the shoelaces are folded or formed into loops and allowed to hang loose over the shoes.

SUMMARY

This section provides a general summary of the disclosure, and is not a comprehensive disclosure of its full scope or all of its features.

Example embodiments of the present disclosure generally relate to shoelace retainers for use with shoes. In one example embodiment, a shoelace retainer generally includes a base defining at least one channel for receiving a first portion of a shoelace therein while the shoelace is coupled to a shoe, thereby coupling the shoelace retainer to the shoe; and a cap associated with the base and defining at least one receptacle relative to (and/or together with) the base where the at least one receptacle is configured to receive a second portion of the shoelace when the base is coupled to the shoe.

In another example embodiment, a shoelace retainer generally includes a base having means for coupling the shoelace retainer to the shoe, and a cap associated with the base and having means for retaining a portion of a shoelace of the shoe in the shoelace retainer (e.g., between the cap and the base, etc.) when the base is coupled to the shoe.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
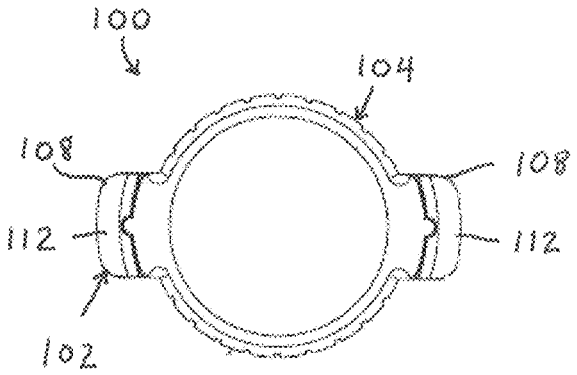
FIG. 1 is a top plan view of an example embodiment of a shoelace retainer including one or more aspects of the present disclosure.
Figure 2:
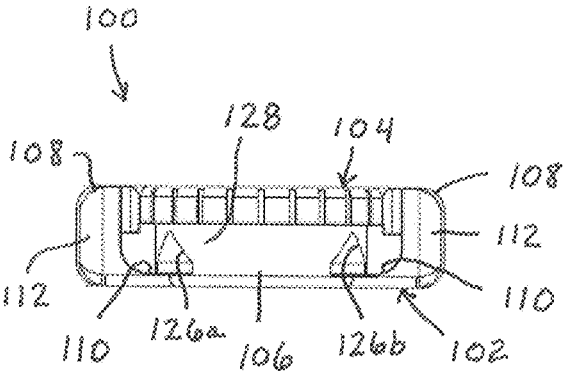
FIG. 2 is a front elevation view of the shoelace retainer of FIG. 1.
Figure 3:
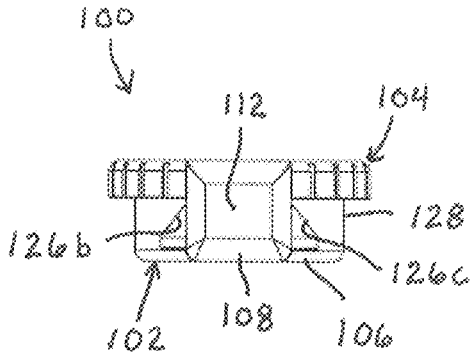
FIG. 3 is a side elevation view of the shoelace retainer of FIG. 1.
Figure 4:
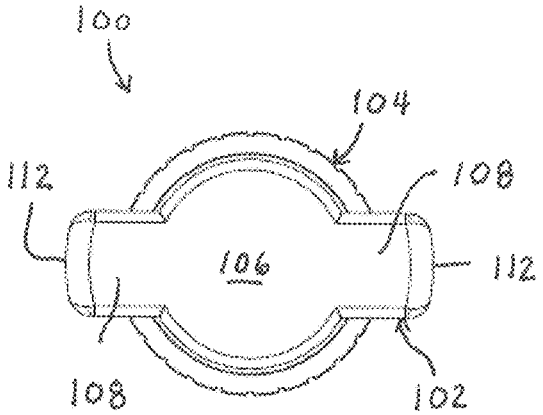
FIG. 4 is a bottom plan of the shoelace retainer of FIG. 1.
Figure 5:
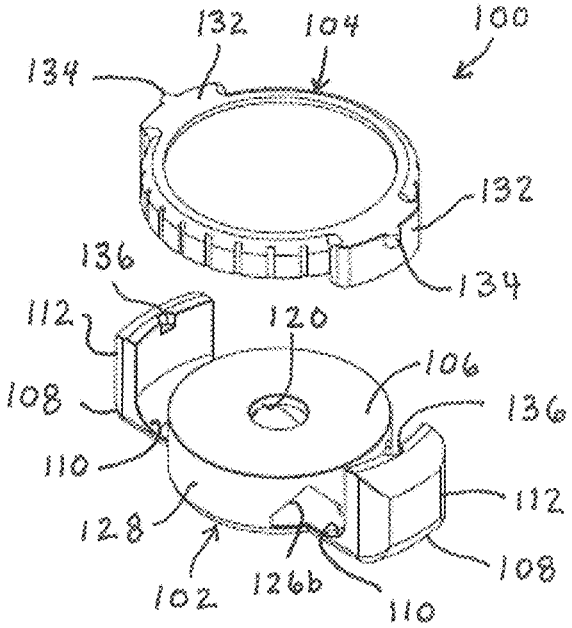
FIG. 5 is an exploded perspective view of the shoelace retainer of FIG. 1.
Figure 6:
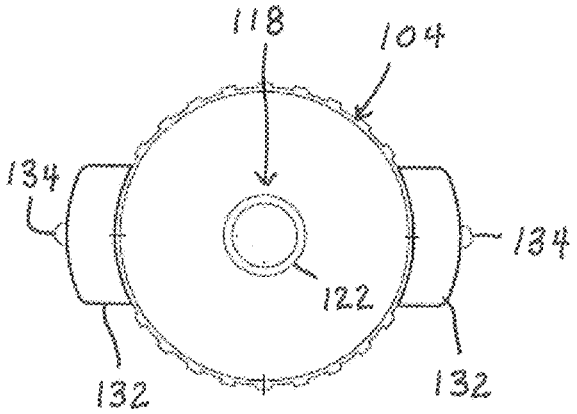
FIG. 6 is a bottom plan view of a cap of the shoelace retainer of FIG. 1.
Figure 7:
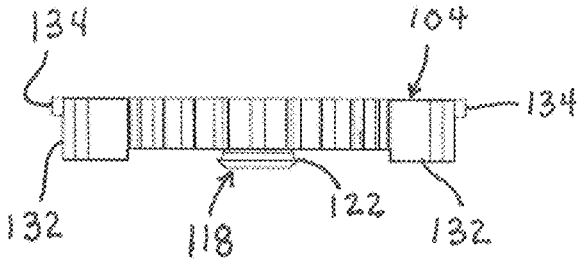
FIG. 7 is a front elevation view of the cap of FIG. 6.
Figure 8:
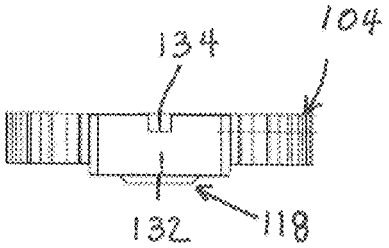
FIG. 8 is a side elevation view of the cap of FIG. 6.
Figure 9:
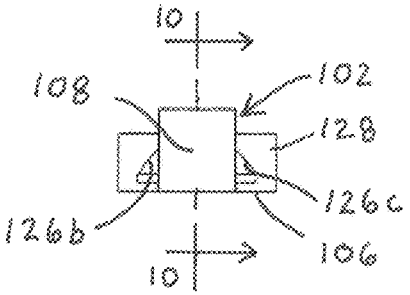
FIG. 9 is a side elevation view of a base of the shoelace retainer of FIG. 1.
Figure 10:
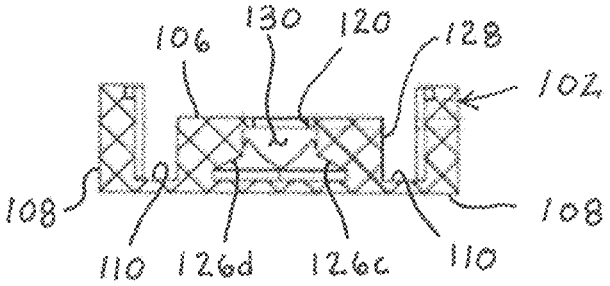
FIG. 10 is a section view of the base taken in a plane including line 10-10 in FIG. 9.

Example embodiments will now be described more fully with reference to the accompanying drawings. The description and specific examples included herein are intended for purposes of illustration only and are not intended to limit the scope of the present disclosure.

FIGS. 1-19 illustrate an example embodiment of a shoelace retainer 100 for use with a shoe and including one or more aspects of the present disclosure. The shoelace retainer 100 is configured (e.g., sized, shaped, constructed, etc.) to couple to a shoe and then retain free end portions of a shoelace threaded to the shoe (e.g., where the shoelace is threaded to the shoe via eyelets of the shoe, etc.) to help inhibit the free ends from untying (e.g., to help inhibit a knot formed by the free ends of the shoelace from coming undone, etc.). This will be described in more detail hereinafter.

As shown in FIGS. 1-5, the illustrated shoelace retainer 100 generally includes a base 102 and a cap 104 coupled to the base 102. The base 102 includes a body 106 and arms 108 extending away from the body 106. And, a plateau 110 of each of the arms 108 extends generally horizontally away from the body 106, with an end portion 112 of each of the arms 108 then extending generally vertically upward from the plateau 110. In the illustrated embodiment, the base 102 includes two arms 108 extending away from the body 106 on generally opposite sides of the body 106. In other embodiments, however, the base 102 may include more than the two arms 108 (e.g., three arms, four arms, etc.) or fewer than the two arms 108 (e.g., one arm, no arms, etc.), for example, extending away from the body 106 in a similar manner to the arms 108.

The cap 104 of the shoelace retainer 100 is coupled to the base 102 generally at the body 106 of the base 102. In this position, the cap 104 is located generally between the arms 108 of the base 102, with an upper surface of the cap 104 generally aligned with (or generally flush with) an upper portion of the arms 108 (e.g., with an upper portion of the end portion 112 of each of the arms 108, etc.) (although this is not required in all embodiments).

With additional reference to FIGS. 6-10, the cap 104 of the shoelace retainer 100 is also removeably coupled to the base 102. In particular, the cap 104 includes a protrusion 118 configured to snap-fit into an opening 120 of the base 102. In so doing, an enlarged lip 122 of the protrusion 118 is configured to secure within the opening 120 of the base 102, generally under an upper surface of the body 106 of the base 102 (e.g., the enlarged lip 122 is configured to snap-fit into the opening 120 and position generally under the upper surface of the body 106 of the base 102, etc.). The cap 104 is then positioned, when coupled to the base 102, on the base 102 and generally between the arms 108 of the base 102 as described above. As further described below, this coupling of the cap 104 to the base 102 (via the protrusion 118) allows the cap 104 to rotate relative to the base 102. With that said, it should be appreciated that in other embodiments of the present disclosure, the cap 104 of the shoelace retainer 100 may be integral with the base 102 (e.g., with the base 102 and the cap 104 formed together as one piece, etc.), but still be moveable (or not) relative to the base 102 as described herein.

The base 102 of the shoelace retainer 100, and in particular the body 106 thereof, further includes multiple openings **126*a-d* defined along a sidewall portion 128 of the body 106. The openings 126*a-d* extend into and generally through (and are in communication with) an interior region 130 of the body 106. Corresponding pairs of the openings 126*a*, 126*c* and 126*b*, 126*d* then define channels extending through the body 106 (and through the interior region 130 of the body 106). As will be described in more detail hereinafter, the channels are then configured to receive portions of a shoelace therethrough for coupling the shoelace retainer 100 to a shoe (broadly, the base 102 of the body 106 defines means (e.g., the channels defined through the base 102 via the pairs of openings 126*a*, 126*c* and 126*b*, 126*d*, etc.) for coupling the shoelace retainer 100** to the shoe).

Figure 11:
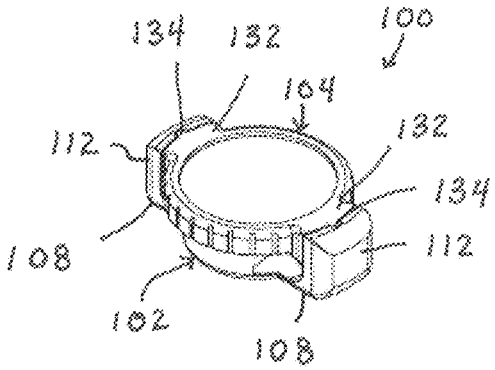
FIGS. 11 and 12 are perspective views of the shoelace retainer of FIG. 1 illustrating movement of the cap of the shoelace retainer relative to the base.
Figure 12:
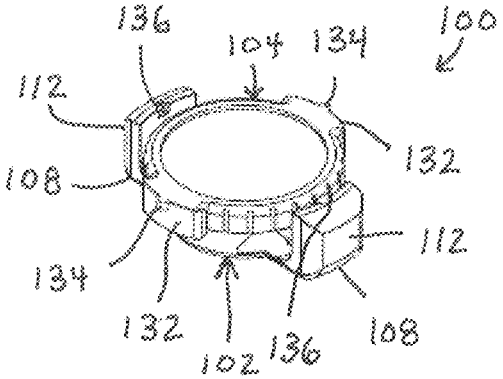
Figure 14:
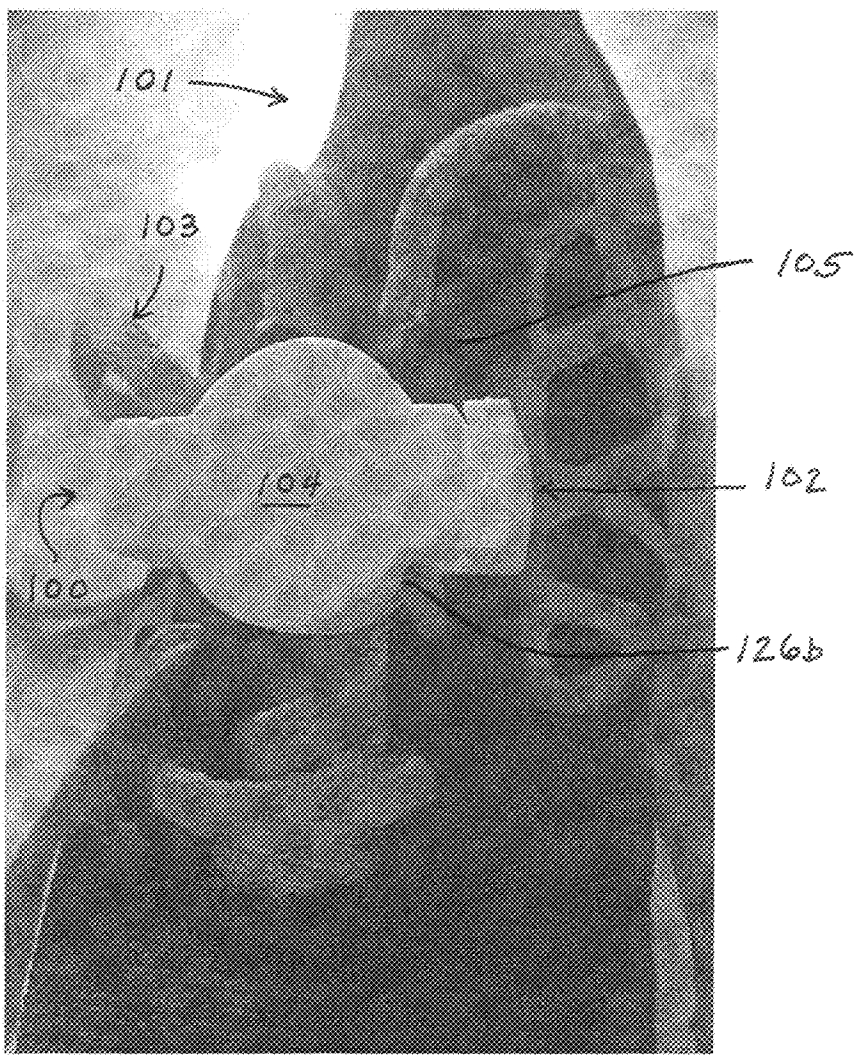
FIGS. 13-19 illustrate an example operation of installing the shoelace retainer of FIG. 1 to a shoe.
Figure 13:
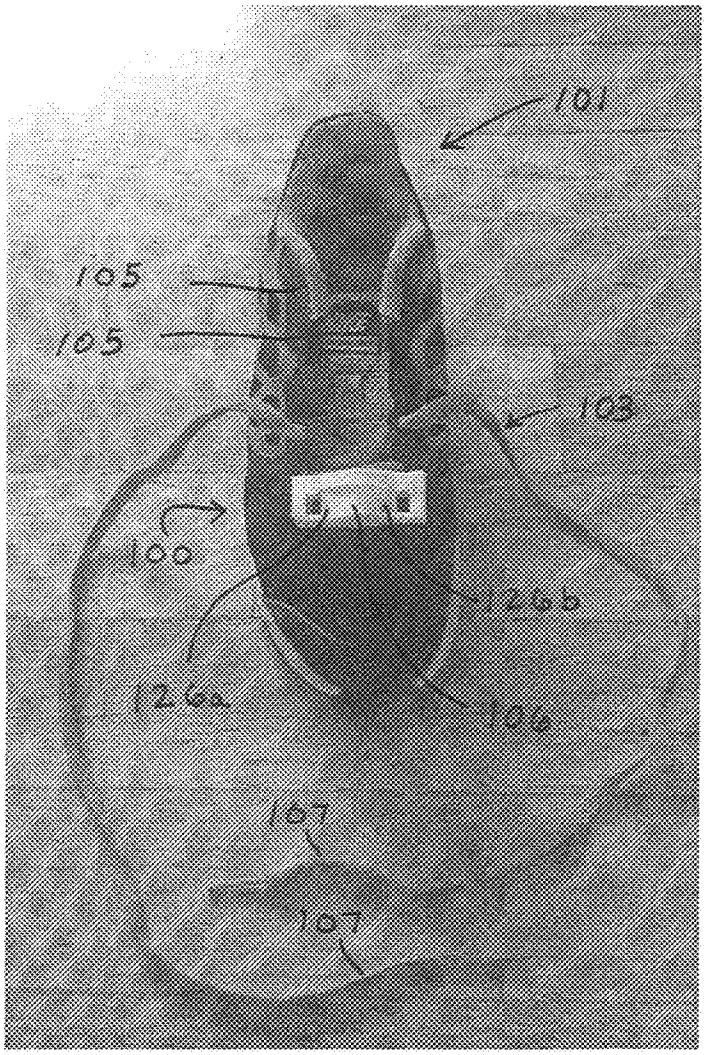

With reference now to FIGS. 11 and 12, the cap 104 of the shoelace retainer 100 is moveable (e.g., pivotable, etc.) relative to the base 102 between a closed position (FIG. 11) and an open position (FIG. 12). In the closed position, wings 132 of the cap 104 are positioned generally in alignment with the arms 108 of the base 102 (generally over the plateaus 110 of the arms 108). And, protrusions 134 of the wings 132 are configured to fit within recesses 136 of the arms 108 (specifically, of the upwardly extending vertical end portions 112 of the arms 108), to thereby help hold, secure, etc. the shoelace retainer 100 in the closed position (and to help inhibit undesired or unwanted movement of the cap 104 relative to the base 102 (e.g., to help inhibit and/or resist undesired or unwanted movement of the shoelace retainer 100 to the open position, etc.)). When desired, the shoelace retainer 100 can be moved to the open position by disengaging the protrusions 134 of the wings 132 from the recesses 136 of the arms 108, and then moving the cap 104 (e.g., rotating the cap 104, etc.) relative to the base 102 (e.g., about ninety degrees, greater than ninety degrees, less than ninety degrees, etc.).

Then, and as will be described in more detail next, when the shoelace retainer 100 is coupled to a shoe (as generally described above) and is in the open position, end portions of a shoelace (where the shoelace is threaded to a shoe) may be positioned in the shoelace retainer 100 along the plateaus 110 of the arms 108 (e.g., the free end portions of the shoelace including bow portions, etc.). The shoelace retainer 100 may then be moved to the closed position, whereby the wings 132 of the cap 104 move generally over the plateaus 110 and secure the end portions of the shoelace, when tied, in the shoelace retainer 100 (whereby receptacles defined by/between the plateaus 110 of the body's arms 108 and the wings of the cap 104 operate to help retain the end portions of the shoelace in the shoelace retainer 100). In this fashion, the cap 104 and the body 106 generally define means (e.g., the receptacles, etc.) for securing portions of the shoelace, when tied, in the shoelace retainer 100.

Figure 15:
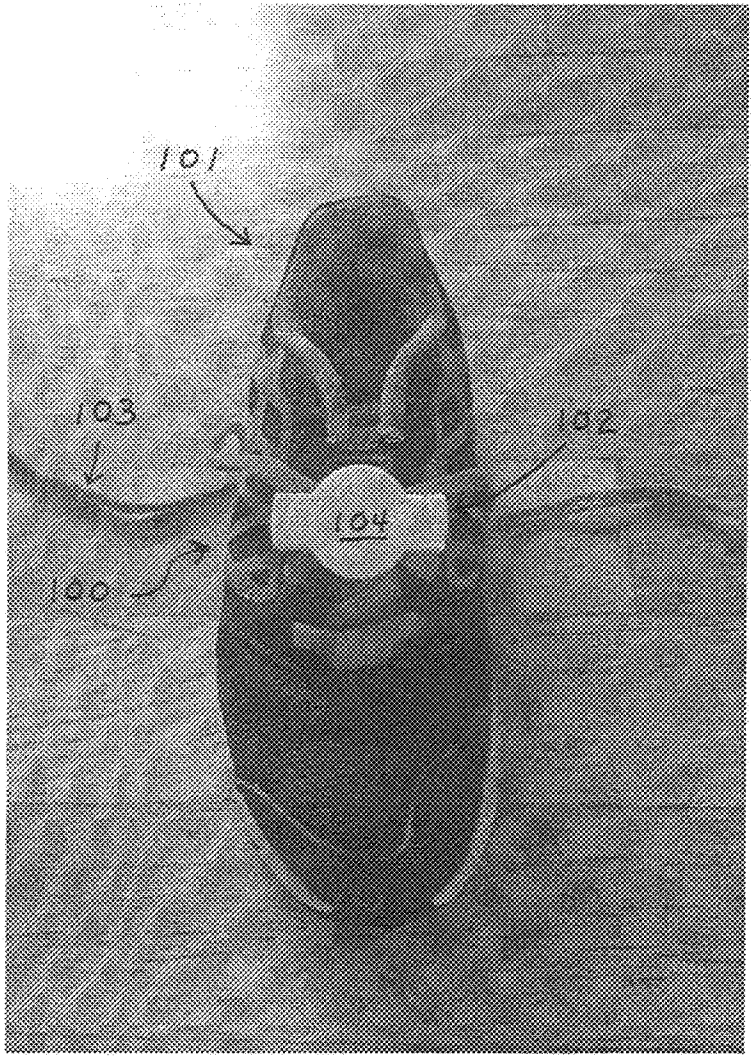

With that said, example installation of the shoelace retainer 100 to a shoe 101 and use thereof to secure a shoelace 103 associated with the shoe 101 to the shoelace retainer 100 will now be described with reference to FIGS. 13-19. As shown, the shoe 101 includes the shoelace 103, where the shoelace 103 is configured to thread through eyelets 105 of the shoe 101 (so that the shoe 101 can ultimately be secured to a foot of an individual using the shoelace 103). In this embodiment, in connection with installing the shoelace retainer 100 to the shoe 101, the shoelace 103 is initially unthreaded from at least some of the eyelets 105 of the shoe 101 (FIG. 13) (e.g., such that the shoelace 103 is threaded through two bottom pairs of eyelets 105 of the shoe 101, such that the shoelace 103 is threaded through at least one bottom pair of eyelets 105 of the shoe 101, such that the shoelace 103 is threaded through three or more bottom pairs of eyelets 105 of the shoe 101, etc.). As shown in FIGS. 13-16, free ends (or free end portions) 107 of the shoelace 103 are then routed, threaded, etc. through the channels defined by the base 102 of the shoelace retainer 100 (and the corresponding pairs of the openings 126*a*, 126*c* and 126*b*, 126*d* formed in the base 102 of the body 106), such that portions of the shoelace 103 associated with each of the free ends 107 generally cross in the interior region 130 of the body's base 102. For example, in the illustrated embodiment, one free end 107 of the shoelace 103 extends through the interior region 130 of the base 102 from opening 126*a* to opening 126*c*, and the other free end 107 of the shoelace 103 extends through the interior region 130 of the base 102 from opening 126*b* to opening 126*d* (FIG. 15).

Figure 16:
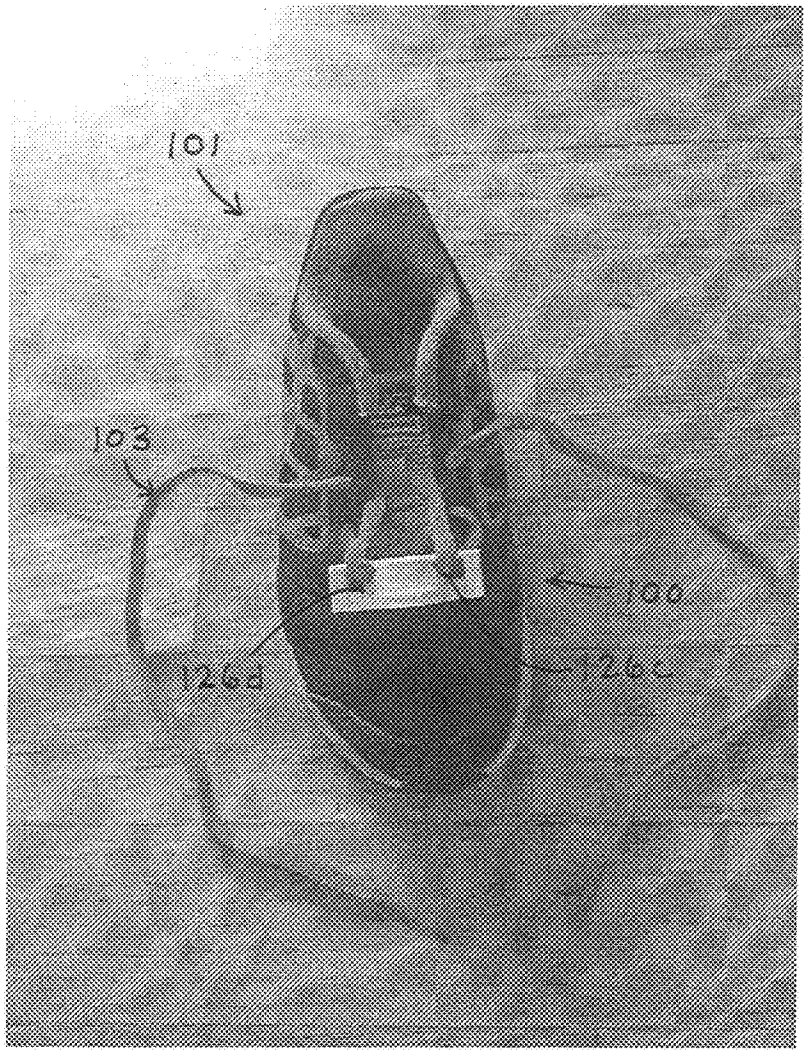
Figure 17:
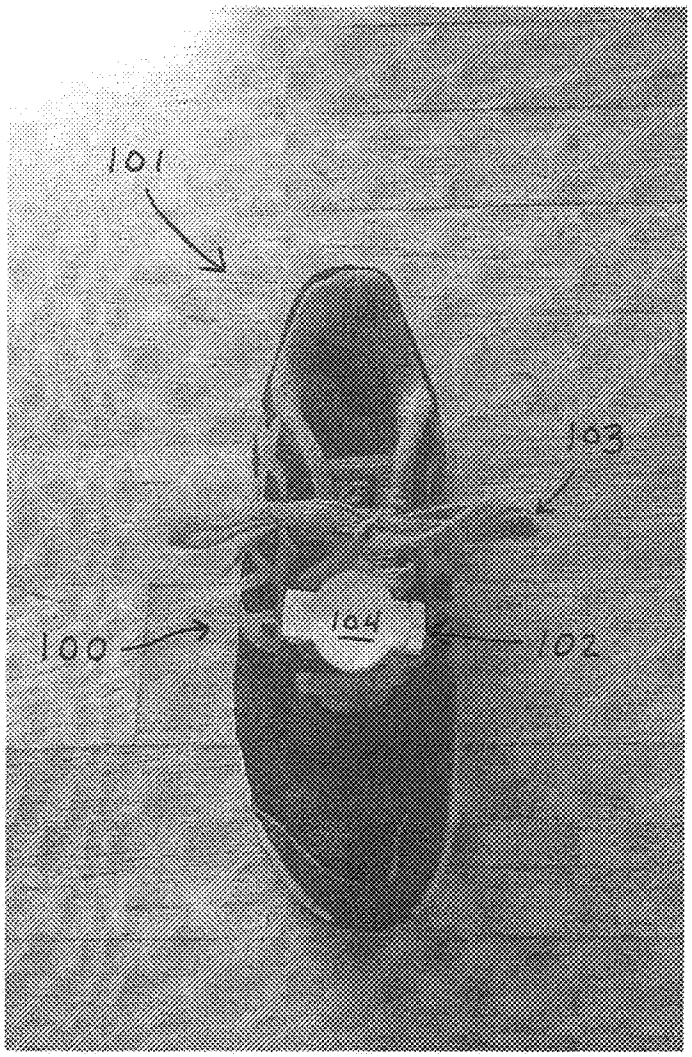
Figure 19:
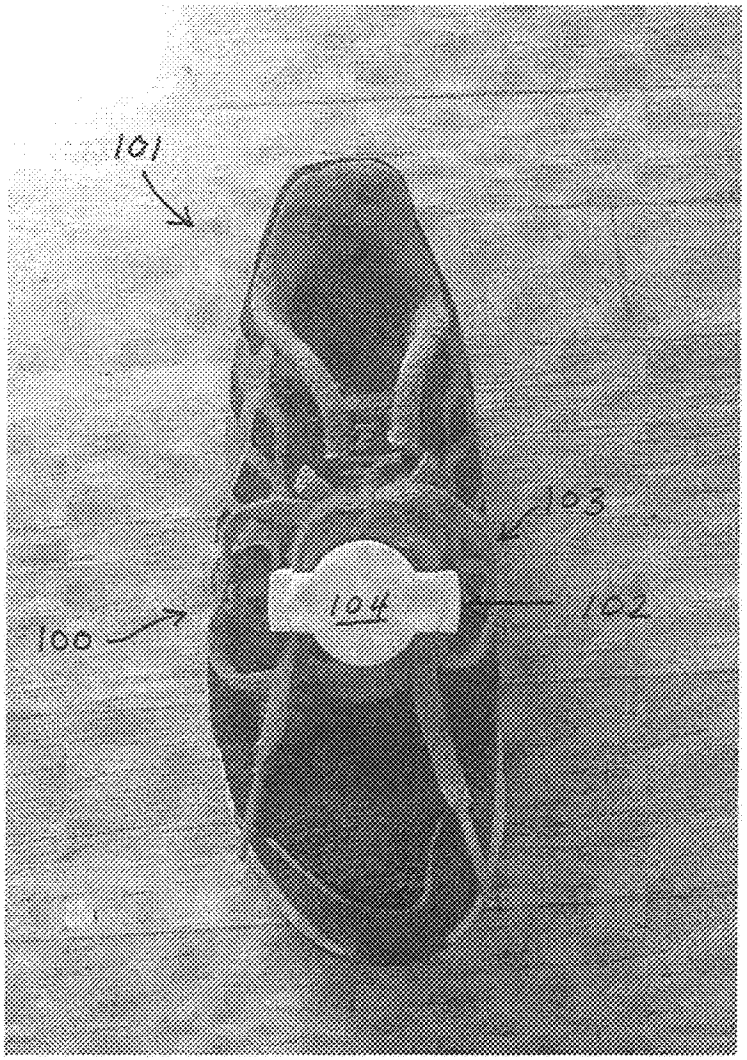
Figure 20:
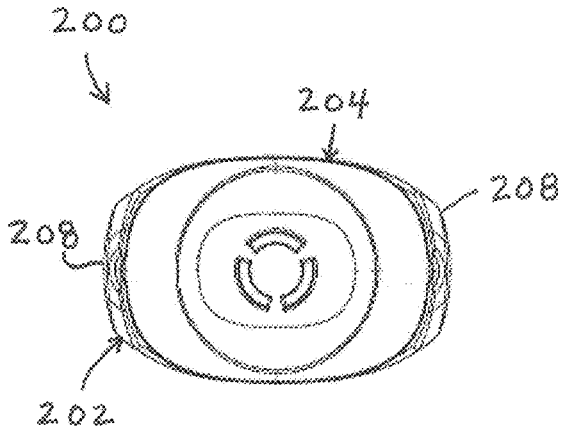
FIG. 20 is a top plan view of another example embodiment of a shoelace retainer including one or more aspects of the present disclosure.
Figure 21:
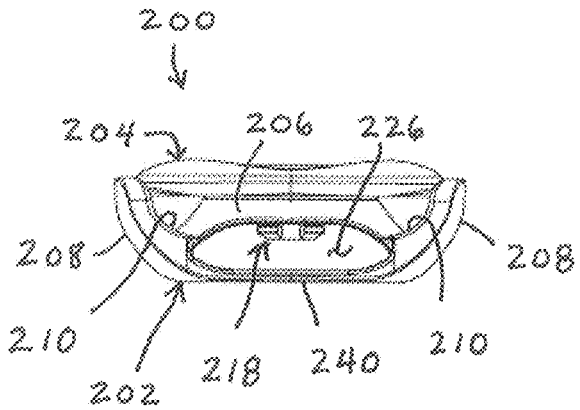
FIG. 21 is a front elevation view of the shoelace retainer of FIG. 20.
Figure 22:
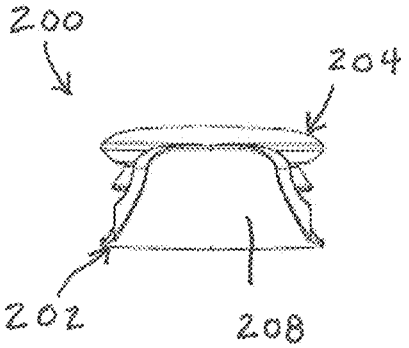
FIG. 22 is a side elevation view of the shoelace retainer of FIG. 20.
Figure 23:
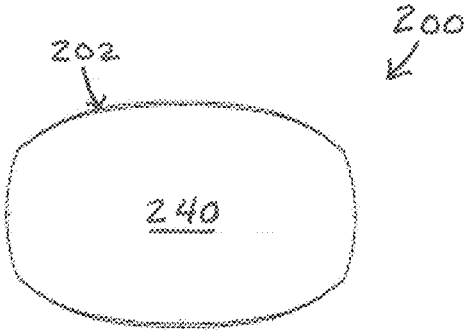
FIG. 23 is a bottom plan of the shoelace retainer of FIG. 20.

Next, as shown in FIG. 16, and with the shoelace retainer 100 now coupled to the shoe 101 (via the shoelace 103), the free ends 107 of the shoelace 103 are threaded, in a conventional manner, through the remaining open eyelets 105 of the shoe 101 (i.e., through the remaining eyelets 105 extending upward toward a foot-opening of the shoe 101). At this time, the shoe 101 may be positioned on the foot of the individual (not shown), and the shoelace 103 tied to secure the shoe 101 to the individual's foot (FIG. 17). As shown, in this example (and as is generally conventional) the shoelace 103 is tied in a bow knot in which the free ends 107 of the shoelace 103 are folded or formed into loops and allowed to hang loose relative to the shoe 101 (along with the free ends).

Figure 18:
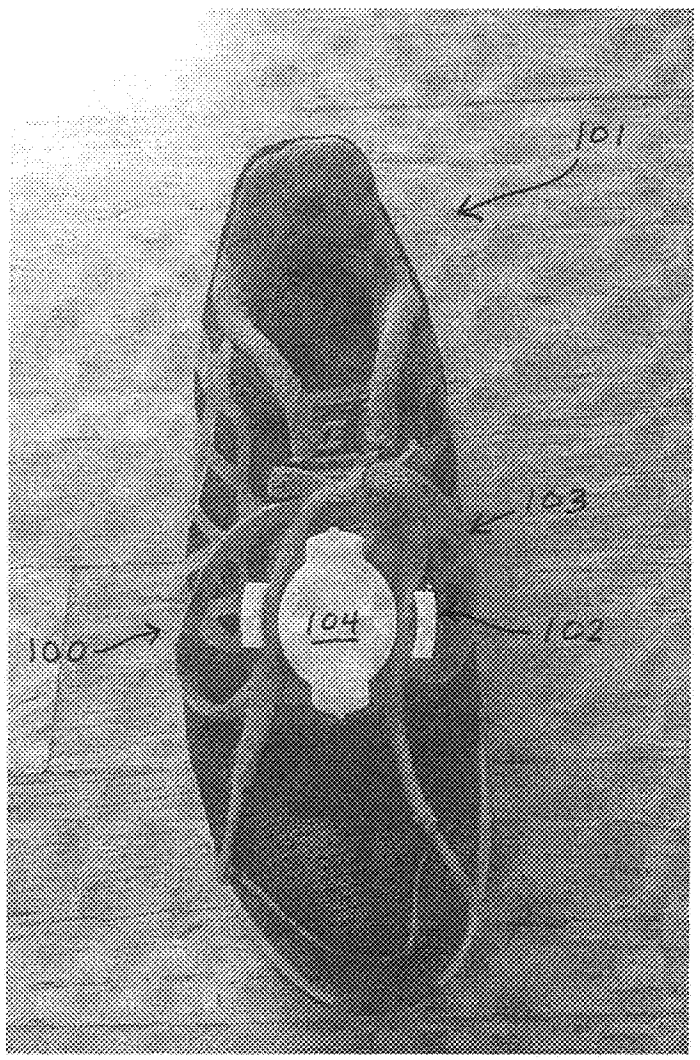

Now, with the shoelace 103 tied, the shoelace retainer 100 (which is installed to the shoe 101 in the closed position in this example) is moved from the closed position (FIG. 17) to the open position (FIG. 18). As described above, this includes moving the cap 104 of the shoelace retainer 100 relative to the base 102, so that the wings 132 of the cap 104 are moved away from the arms 108 of the base 102 (e.g., about ninety degrees, etc.). Then, as shown in FIG. 18, portions of the shoelace 103 defining the bows, as well as portions of the shoelace 103 associated with the free ends 107, are each positioned in the shoelace retainer 100 adjacent the plateaus 110 of the arms 108 (such that the shoelace portions extend generally across the plateaus 110 between the body 106 of the base 102 and the corresponding vertically extending end portions 112 of the arms 108). Finally, the shoelace retainer 100 is moved from the open position back to the closed position (FIG. 19) to secure the bow portions and the free ends 107 of the shoelace 103 in the shoelace retainer 100 (i.e., in the receptacles defined by the plateaus 110 of the base's arms 108, the body 106 of the base 102, and the wings 132 of the cap 104).

Thus, when the shoelace retainer 100 of the present disclosure is coupled to the shoe 101, the free ends 107 of the tied shoelace 103 (generally associated with the formed bows) are positioned within the receptacles of the shoelace retainer 100 to help inhibit the bows from being inadvertently untied. As can be appreciated, when the shoelace 103 is tied in the bow knot, as is conventional, the free ends 107 of the shoelace are folded or formed into the loops and allowed to hang loose over the shoe. However, in this position, because the bow knot is a type of slip knot, the loops may be inadvertently engaged and pulled whereby the bow knot becomes undone (i.e., the shoelace 103 becomes untied). By positioning at least part of the bow knot in the shoelace retainer 100 as described above, such inadvertent engagement of the loops of the bow knot may be avoided (and which may help resist inadvertent untying of the shoelace 103).

What's more, the illustrated shoelace retainer 100 is free of springs. In other words, the shoelace retainer 100 does not require springs to couple the shoelace retainer 100 to the shoe 101 or to retain the free end 107 of the shoelace 103 (or the bow knot portions formed thereby) in the receptacles of the shoelace retainer 100. As can be appreciated, this may provide for easier operation of the shoelace retainer 100, as required strength to manipulate such springs to overcome their spring forces is not required.

FIGS. 20-36 illustrate another example embodiment of a shoelace retainer 200 for use with a shoe and including one or more aspects of the present disclosure. Again, the shoelace retainer 200 is configured (e.g., sized, shaped, constructed, etc.) to couple to a shoe and then retain free ends of a shoelace threaded to the shoe to help inhibit the free ends from untying (e.g., to help inhibit a knot formed by the free ends of the shoelace from coming undone, etc.).

The shoelace retainer 200 is similar to the shoelace retainer 100 described above, and operates in substantially the same manner (such that the above description for the shoelace retainer 100 generally applies to the shoelace retainer 200). For example, as shown in FIGS. 20-24, the shoelace retainer 200 generally includes a base 202 and a cap 204 coupled to the base 202. The base 202 includes a body 206 and arms 208 extending away from the body 206. And, a plateau 210 of each of the arms 208 extends generally away from the body 206, with a free end portion of each of the arms 208 then extending generally vertically upward from the plateau 210. The cap 204 of the shoelace retainer 200, then, is coupled to the base 202 generally at the body 206 of the base 202. In this position, the cap 204 is located generally between the arms 208 of the base 202, with an upper surface of the cap 204 generally aligned with (or generally flush with) an upper portion (e.g., the free end portion, etc.) of the arms 208 (although this is not required in all embodiments).

Figure 24:
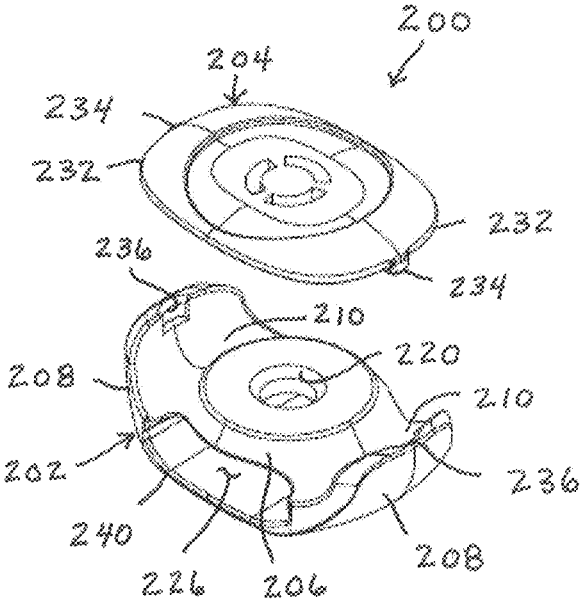
FIG. 24 is an exploded perspective view of the shoelace retainer of FIG. 20.
Figure 25:
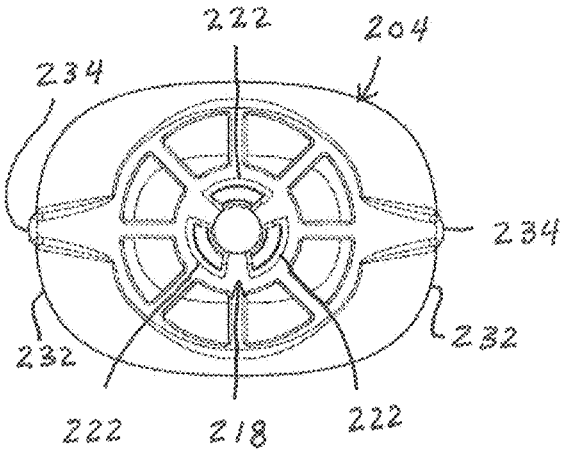
FIG. 25 is a bottom plan view of a cap of the shoelace retainer of FIG. 20.
Figure 26:
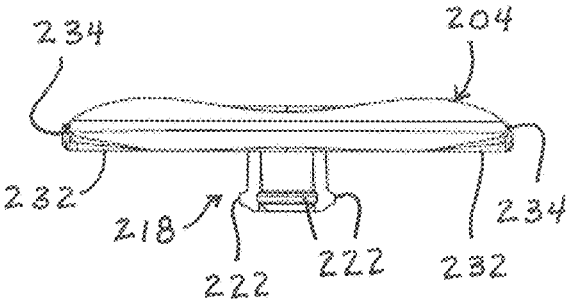
FIG. 26 is a front elevation view of the cap of FIG. 25.
Figure 27:
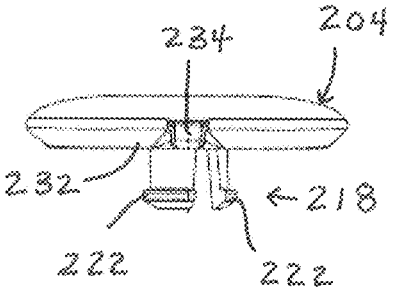
FIG. 27 is a side elevation view of the cap of FIG. 25.

In addition, the cap 204 of the shoelace retainer 200 is removeably coupled to the base 202. In particular, and with additional reference to FIGS. 25-27, a protrusion 218 of the cap 204 (defining multiple prongs) is configured to snap-fit into an opening 220 of the base 202 (FIG. 24). In so doing, an enlarged lip 222 of the protrusion 218 (in particular, of each of the multiple prongs) is configured to secure within the opening 220 of the base 202 generally under an upper surface of the body 206 of the base 202 (FIG. 21) (e.g., the enlarged lip 222 is configured to snap-fit into the opening 220 and position generally under the upper surface of the body 206 of the base 202, etc.). The cap 204 can then be positioned, as described above, on the base 202 generally between the arms 208 of the base 202 (whereby the protrusion 218 allows for pivotable movement of the cap 204 relative to the base 202).

Figure 28:
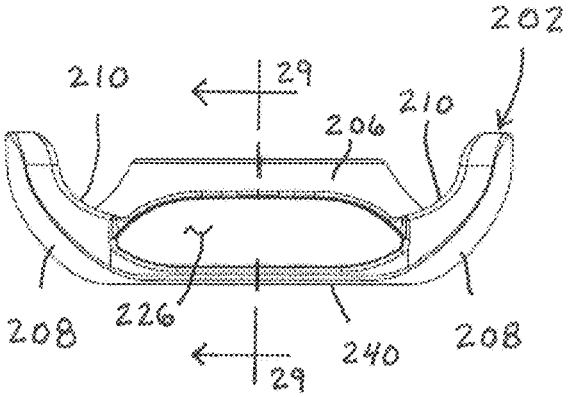
FIG. 28 is a side elevation view of a base of the shoelace retainer of FIG. 20.
Figure 29:
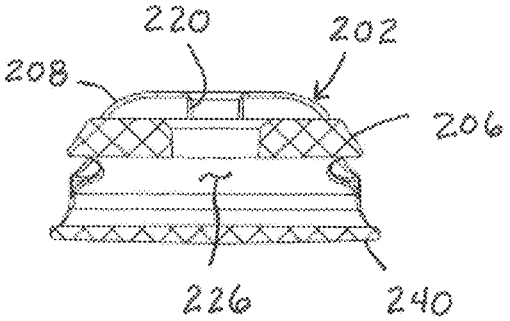
FIG. 29 is a section view of the base taken in a plane including line 29-29 in FIG. 28.
Figure 30:
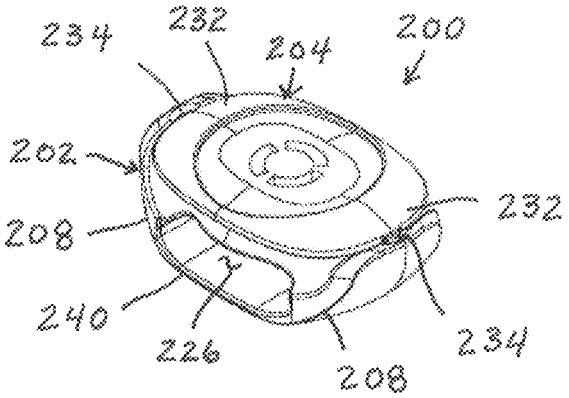
FIGS. 30 and 31 are perspective views of the shoelace retainer of FIG. 20 illustrating movement of the cap of the shoelace retainer relative to the base.
Figure 31:
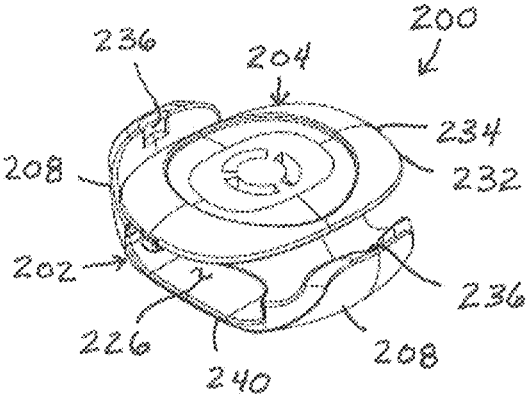

With further reference to FIGS. 28 and 29, in this embodiment, and different from the shoelace retainer 200 described above, the base 202 of the shoelace retainer 200 includes a leg 240 extending between the arms 208. The leg 240 defines an opening 226 that extends through the base 202 generally between the leg 240 and the body 206 of the base 202. In connection therewith, the opening 226 may be viewed as defining a channel (extending through the opening 226 and through the base 202) configured to receive portions of a shoelace therethrough for coupling the shoelace retainer 200 to a shoe (broadly, the base 202 defines means (e.g., the channel, together with the leg 240 and the body 206 of the base 202 defining the channel; etc.) for coupling the shoelace retainer 200 to the shoe). The cap 204 of the shoelace retainer 200 is then moveable (e.g., pivotable, etc.) relative to the base 202 between a closed position (FIG. 30) and an open position (FIG. 31), in a similar manner to the shoelace retainer 100 described above, to ultimately secure free end portions of a shoelace to the shoelace retainer 200.

Figure 32:
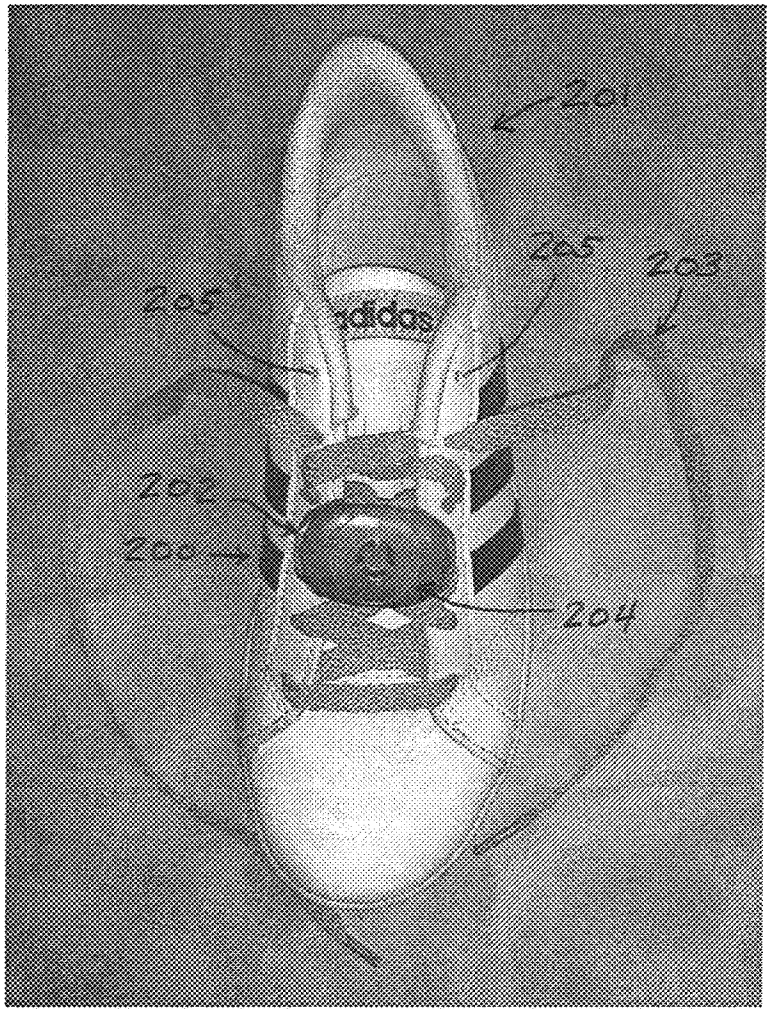
FIGS. 32-36 illustrate an example operation of installing the shoelace retainer of FIG. 20 to a shoe.
Figure 33:
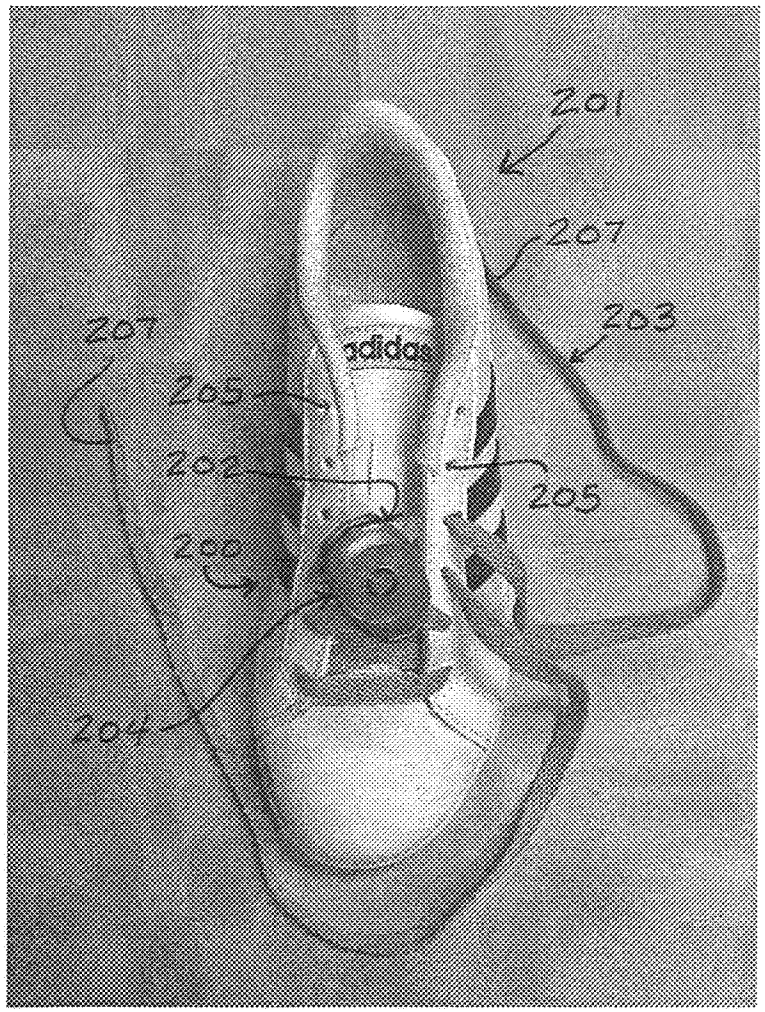
Figure 35:
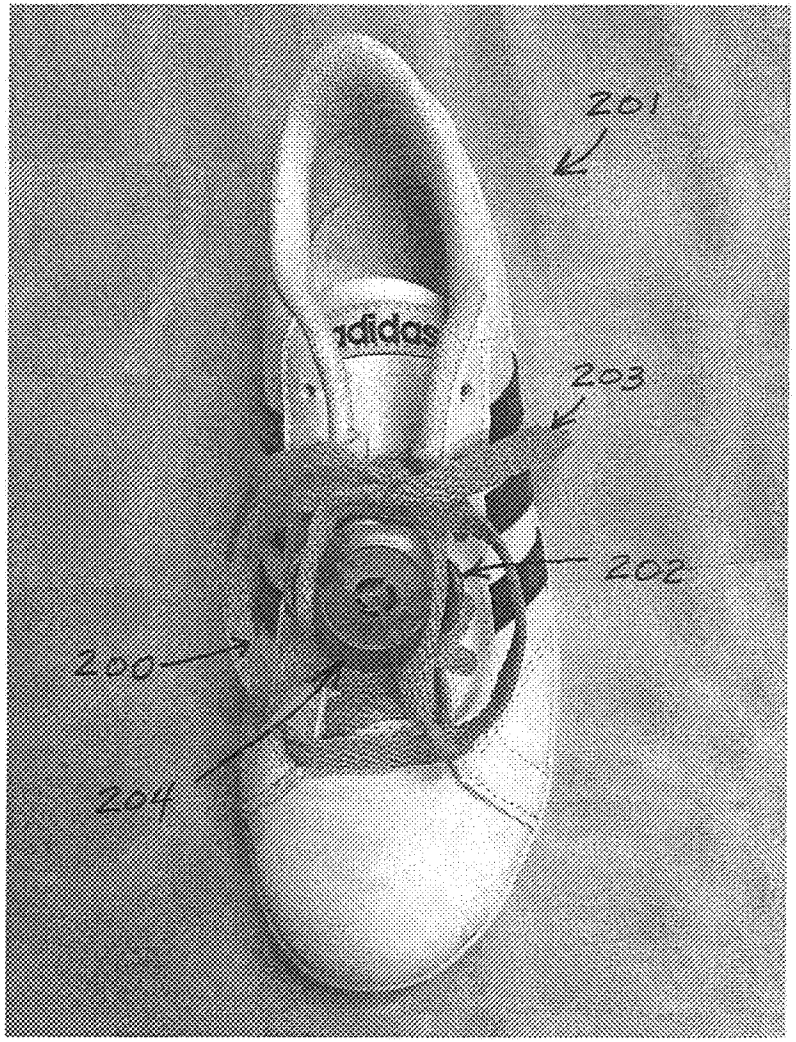
Figure 34:
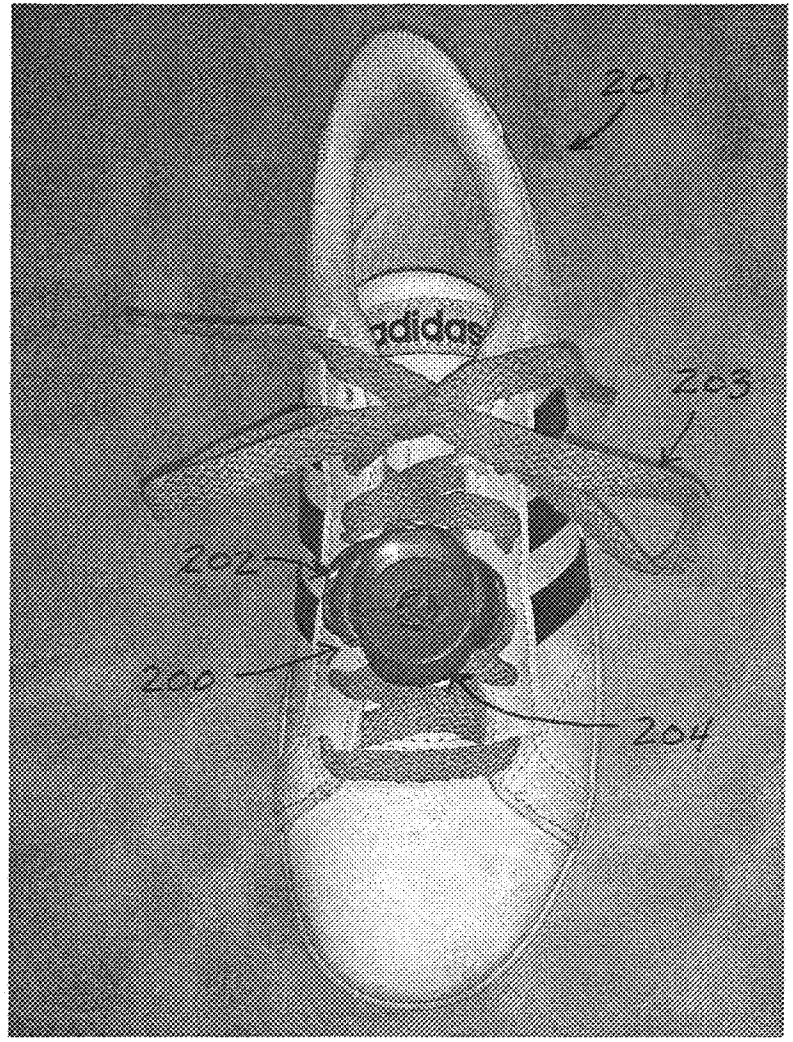
Figure 36:
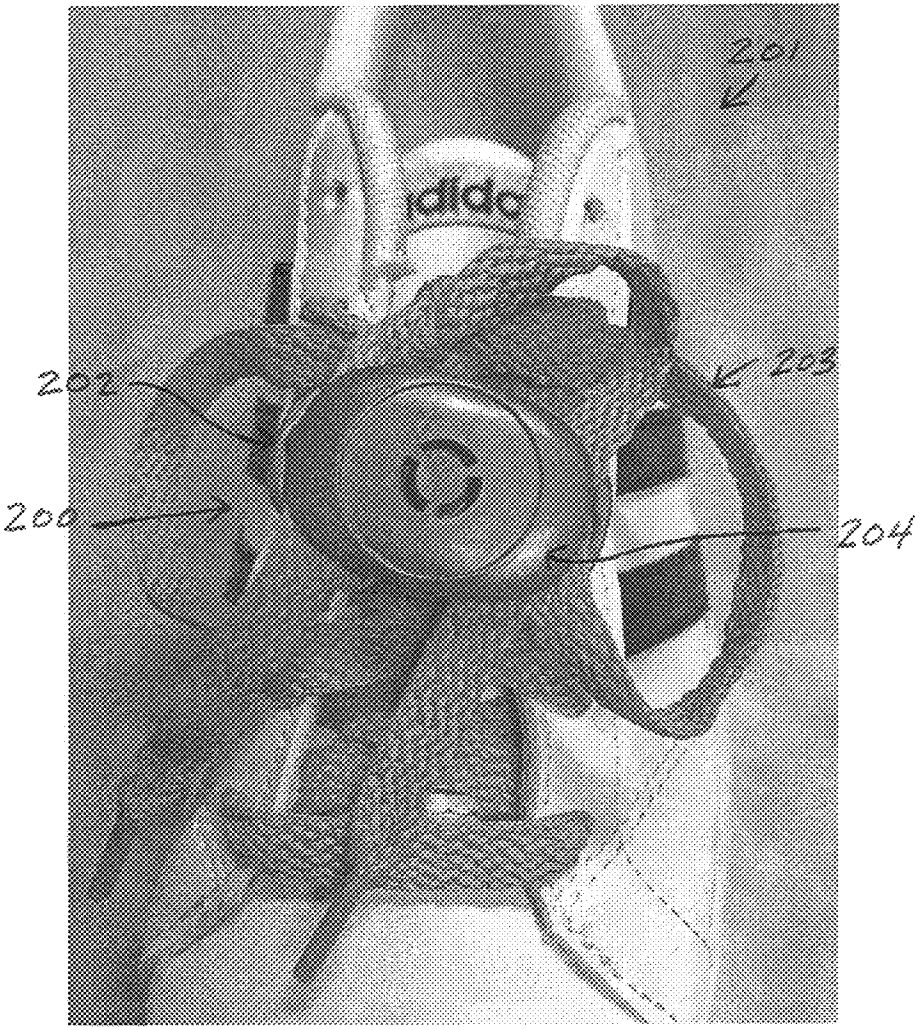
Figure 37:
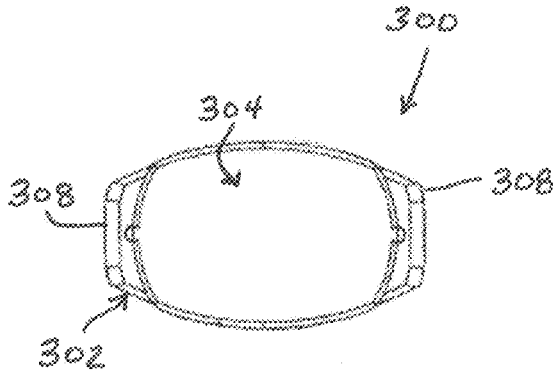
FIG. 37 is a top plan view of another example embodiment of a shoelace retainer including one or more aspects of the present disclosure.

With that said, example installation of the shoelace retainer 200 to a shoe 201 and use thereof to secure a shoelace 203 associated with the shoe 201 to the shoelace retainer 200 will now be described with reference to FIGS. 32-36. Shoelace 203 is initially unthreaded from at least some of eyelets 205 of the shoe 201 (FIG. 32). Free ends 207 of the shoelace 203 are then routed, threaded, etc. through the channel defined by the opening 226 of the base 202, such that portions of the shoelace 203 associated with each of the free ends 207 generally cross within the opening 226 (FIGS. 32 and 33). Next, and with the shoelace retainer 200 now coupled to the shoe 201 (via the shoelace 203), the free ends 207 of the shoelace 203 are threaded, in a conventional manner, through the remaining open eyelets 205 of the shoe 201 (FIG. 33). At this time, the shoe 101 may be positioned on the foot of the individual (not shown), and the shoelace 103 tied to secure the shoe 101 to the individual's foot (FIG. 34). As shown, in this example (and as is generally conventional) the shoelace 203 is tied in a bow knot in which the free ends 207 of the shoelace 203 are folded or formed into loops and allowed to hang loose relative to the shoe 201 (along with the free ends).

Now, with the shoelace 203 tied, the shoelace retainer 200 (which is installed to the shoe 201) is moved from the closed position to the open position (FIG. 34). As described above, this includes moving the cap 204 of the shoelace retainer 200 relative to the base 202, so that the wings 232 of the cap 204 are moved away from the arms 208 of the base 202. Then, portions of the shoelace 203 defining the bows, as well as portions of the shoelace 203 associated with the free ends 207, are each positioned in the shoelace retainer 200 adjacent the plateaus 210 of the arms 208 (such that the shoelace portions extend generally across the plateaus 210 between the body 206 of the base 202 and the corresponding vertically extending end portions of the arms 208). Finally, the shoelace retainer 200 is moved from the open position to the closed position (FIG. 36) to secure the bow portions and the end portions 207 of the shoelace 203 in the shoelace retainer 200 (i.e., in receptacles defined by the plateaus 210 of the base's arms 208, the body 206 of the base 202, and the wings 232 of the cap 204).

FIGS. 37-43 illustrate another example embodiment of a shoelace retainer 300 for use with a shoe and including one or more aspects of the present disclosure. Again, the shoelace retainer 300 is configured (e.g., sized, shaped, constructed, etc.) to couple to a shoe and then retain free ends of a shoelace threaded to the shoe to help inhibit the free ends from untying (e.g., to help inhibit a knot formed by the free ends of the shoelace from coming undone, etc.).

The shoelace retainer 300 is similar to the shoelace retainers 100, 200 described above, and operates in substantially the same manner (such that the above descriptions for the shoelace retainers 100, 200 generally apply to the shoelace retainer 300). For example, the shoelace retainer 300 generally includes a base 302 and a cap 304 coupled to the base 302. The base 302 includes a body 306 and arms 308 extending away from the body 306. And, a plateau 310 of each of the arms 308 extends generally away from the body 306, with a free end portion of each of the arms 308 then extending generally vertically upward from the plateau 310. The cap 304 of the shoelace retainer 300, then, is coupled to the base 302 generally at the body 306 of the base 302. In this position, the cap 304 is located generally between the arms 308 of the base 302, with an upper surface of the cap 304 generally aligned with (or generally flush with) an upper portion (e.g., the free end portion, etc.) of the arms 308 (although this is not required in all embodiments).

Figure 38:
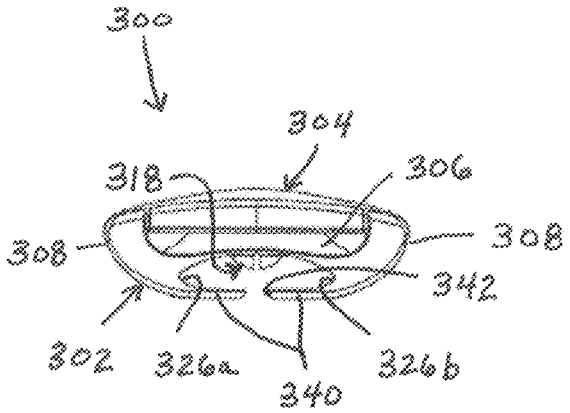
FIG. 38 is a front elevation view of the shoelace retainer of FIG. 37.
Figure 39:
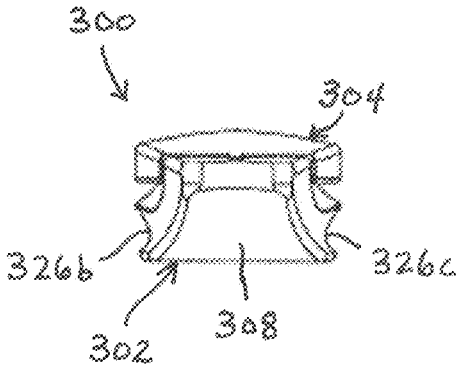
FIG. 39 is a side elevation view of the shoelace retainer of FIG. 37.
Figure 40:
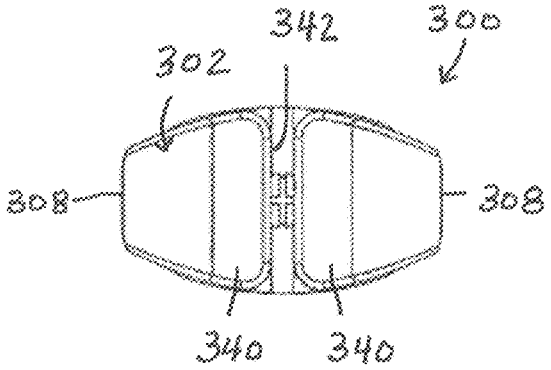
FIG. 40 is a bottom plan of the shoelace retainer of FIG. 37.
Figure 41:
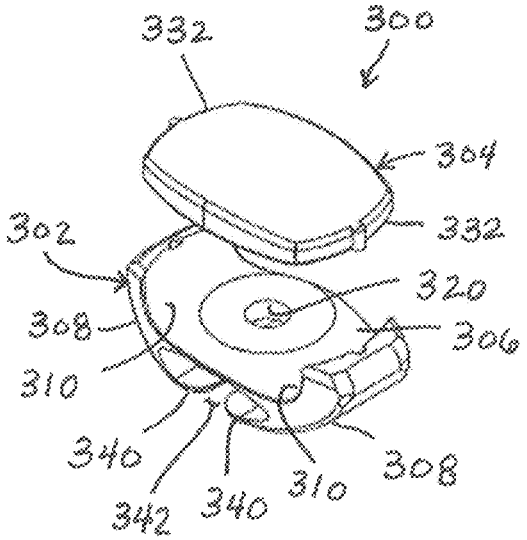
FIG. 41 is an exploded perspective view of the shoelace retainer of FIG. 37.
Figure 42:
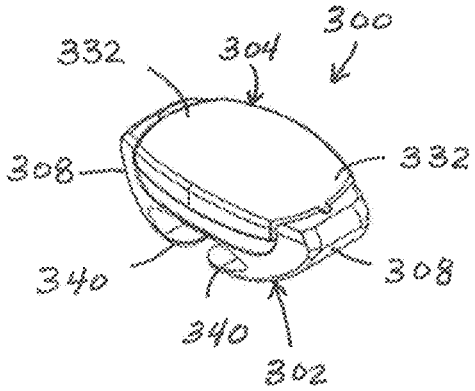
FIGS. 42 and 43 are perspective views of the shoelace retainer of FIG. 37 illustrating movement of the cap of the shoelace retainer relative to the base.
Figure 43:
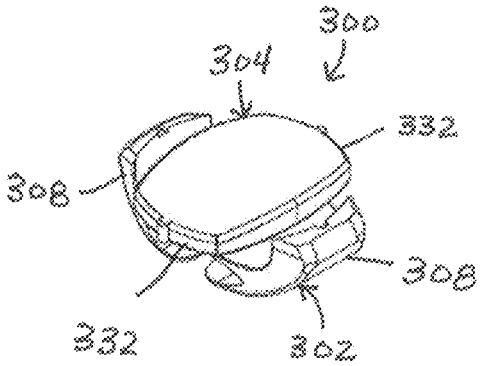
Figure 44:
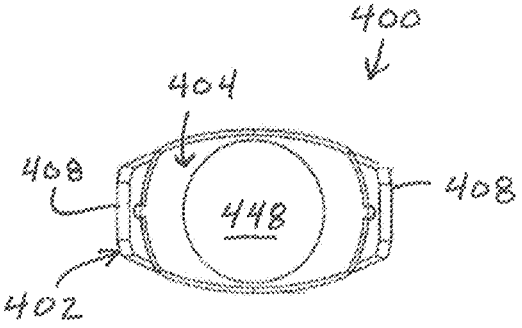
FIG. 44 is a top plan view of another example embodiment of a shoelace retainer including one or more aspects of the present disclosure.
Figure 45:
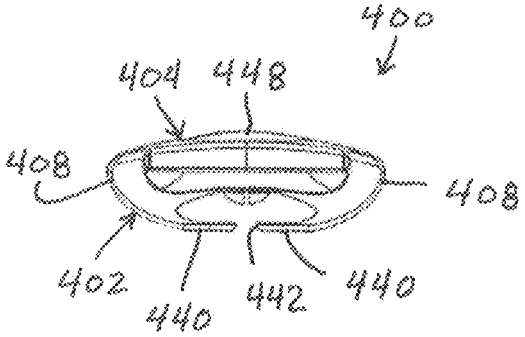
FIG. 45 is a front elevation view of the shoelace retainer of FIG. 44.
Figure 46:
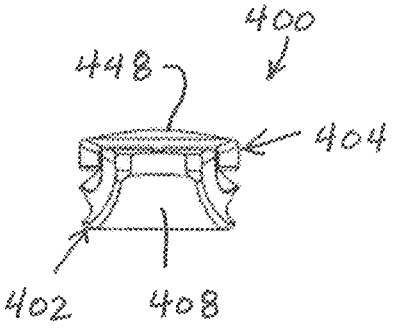
FIG. 46 is a side elevation view of the shoelace retainer of FIG. 44.
Figure 47:
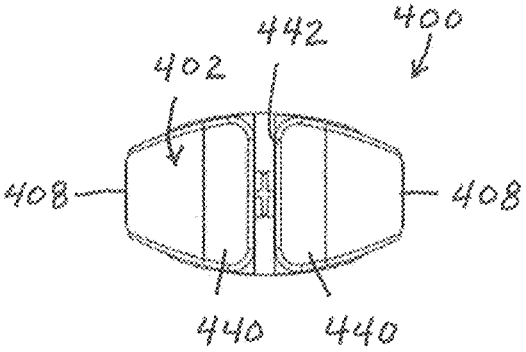
FIG. 47 is a bottom plan of the shoelace retainer of FIG. 44.

In addition, the cap 304 of the shoelace retainer 300 is removeably coupled to the base 302. In particular, a protrusion 318 of the cap 304 is configured to snap-fit into an opening 320 of the base 302 (FIG. 38). In so doing, an enlarged lip 322 of the protrusion 318 is configured to secure within the opening 320 of the base 302 generally under an upper surface of the body 306 of the base 302 (e.g., the enlarged lip 322 is configured to snap-fit into the opening 320 and position generally under the upper surface of the body 306 of the base 302, etc.). The cap 304 can then be positioned, as described above, on the base 302 generally between the arms 308 of the base 302 (whereby the protrusion 318 allows for pivotable movement of the cap 304 relative to the base 302).

In this embodiment, and different from the shoelace retainer 100 described above, the base 302 of the shoelace retainer 300 includes first and second legs 340, and a spacing 342 defined between end portions of the legs 340. The legs 340 generally define openings **326*a-d* relative to the base (generally between the legs 340 and the body 306 of the base 302). Corresponding pairs of the openings 326*a*, 326*c* and 326*b*, 326*d* then define pathways (as part of one or more channels) extending through the body 306. The pathways are configured to receive portions of a shoelace therethrough for coupling the shoelace retainer 300 to a shoe (broadly, the base 302 defines means (e.g., the pathways, together with the legs 340 and the body 306 of the base 302 defining the pathways; etc.) for coupling the shoelace retainer 300 to the shoe). Also in this embodiment, the shoelace retainer 300 can be coupled to a shoe (e.g., the shoelace 103 of the shoe 101, the shoelace 203 of the shoe 202, etc.) without unthreading a shoelace from eyelets of the shoe. This will be described more below. The cap 304 of the shoelace retainer 300 is then moveable (e.g., pivotable, etc.) relative to the base 302 between a closed position (FIG. 42) and an open position (FIG. 43), in a similar manner to the shoelace retainers 100, 200 described above, to ultimately secure free end portions of a shoelace to the shoelace retainer 300**.

With that said, the shoelace retainer 300 of this embodiment may be installed to a shoe while a shoelace of the shoe is fully laced and while the shoelace is even tied (taking these distinctions into account, the shoelace retainer 300 then operates in a generally similar manner to that described above for the shoelace retainers 100, 200). In particular in this embodiment, the shoelace retainer 300 can be coupled to the shoe by simply positioning portions of the shoelace, already threaded through the eyelets of the shoe, through the spacing 342 between the end portions of the legs 340, thereby positioning the shoelace (specifically, crossing portions of the shoelace already threaded to the eyelets of the shoe) into the pathways of the body 306 of the shoelace retainer 300 (defined by the openings 326*a-d* between the legs 340 of the body 306 and the body 306 of the base 302).

Next, with the shoelace retainer 300 now coupled to the shoe (via the threaded shoelace), and with the shoelace already tied or subsequently tied in a bow knot (in which the free ends of the shoelace are folded or formed into loops and allowed to hang loose relative to the shoe), the shoelace retainer 300 is moved to the open position (if not already in the open position). As described above, this includes moving the cap 304 of the shoelace retainer 300 relative to the body 306, so that wings 332 of the cap 304 are moved away from the arms 308 of the base 302 (e.g., about ninety degrees, etc.). Portions of the shoelace defining the bows as well as portions of the shoelace associated with the free ends are then each positioned in the shoelace retainer 300 adjacent the plateaus 310 of the arms 308 (such that the shoelace portions extend generally across the plateaus 310 between the base 302 of the body 306 and the corresponding vertically extending end portions of the arms 308). Finally, the shoelace retainer 300 is moved from the open position to the closed position to secure the shoelace in the shoelace retainer 300 (i.e., in receptacles defined by the plateaus 310 of the body's arms 308 and the wings 332 of the cap 304, whereby the wings 332 of the cap 304 move generally over the plateaus 310). In this fashion, the cap 304 and the body 306 again generally define means (e.g., the receptacles defined by the plateaus 310 of the body's arms 308 and the wings 332 of the cap 304, etc.) for securing portions of the shoelace, when tied, in the shoelace retainer 300. While in the illustrated embodiment, the base 302 includes two legs 340 for use in coupling the shoelace retainer 300 to a shoe, it should be appreciated that the base 302 may include other numbers of legs within the scope of the present disclosure. For example, in one alternative embodiment, the base 302 of the shoelace retainer 300 may include a single leg configured to clip under a shoelace already threaded to a shoe to thereby couple the shoelace retainer 300 to the shoe.

Figure 53:
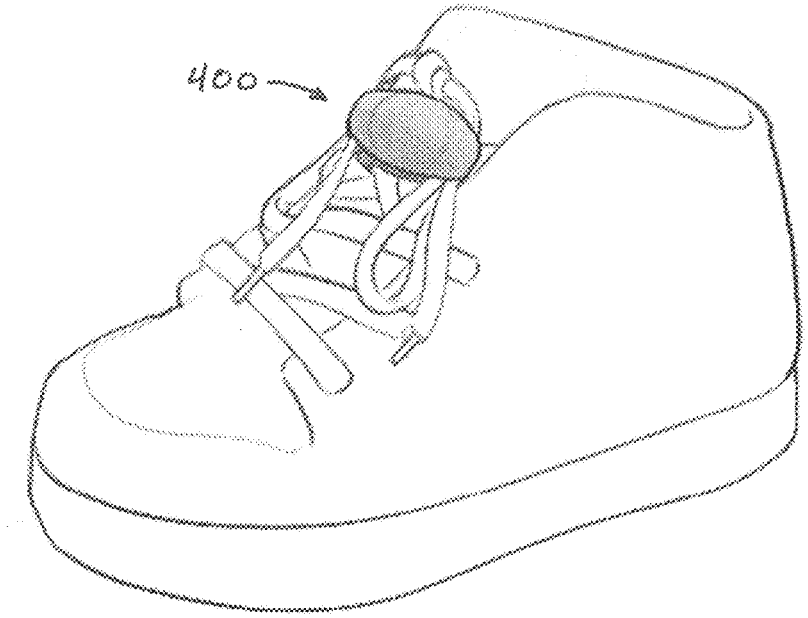
FIG. 53 is a perspective view of a shoe with the shoelace retainer of FIG. 44 shown coupled thereto.

FIGS. 44-53 illustrate still another example embodiment of a shoelace retainer 300 for use with a shoe and including one or more aspects of the present disclosure. Again, the shoelace retainer 400 of this embodiment is configured (e.g., sized, shaped, constructed, etc.) to couple to a shoe and then retain free ends of a shoelace threaded to the shoe (e.g., where the shoelace is already threaded to the shoe via eyelets of the shoe, etc.) to help inhibit the free ends from untying (e.g., to help inhibit a knot formed by the free ends of the shoelace from coming undone, etc.) (FIG. 53).

As shown in FIGS. 44-50, the shoelace retainer 400 is substantially the same as the shoelace retainer 300 described above with reference to FIGS. 37-43, and operates in substantially the same manner (e.g., may be installed to a shoe and used therewith in the same manner, etc.). For example, the shoelace retainer 400 includes a base 402 and a cap 404 coupled to the base 402. And, the base 402 includes a body 406 and arms 408 extending away from the body 406. In addition, the base 402 of the shoelace retainer 400 includes first and second legs 440, and a spacing 442 defined between end portions of the legs 440, for use in coupling the shoelace retainer 400 to a shoe.

Figure 48:
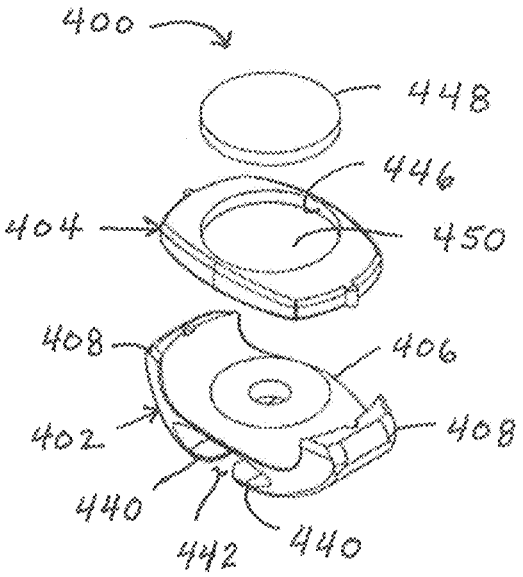
FIG. 48 is an exploded perspective view of the shoelace retainer of FIG. 44.
Figure 49:
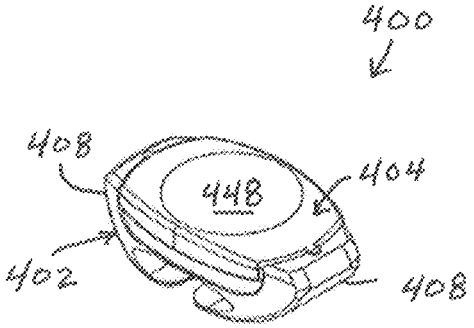
FIGS. 49 and 50 are perspective views of the shoelace retainer of FIG. 44 illustrating movement of the cap of the shoelace retainer relative to the base.
Figure 50:
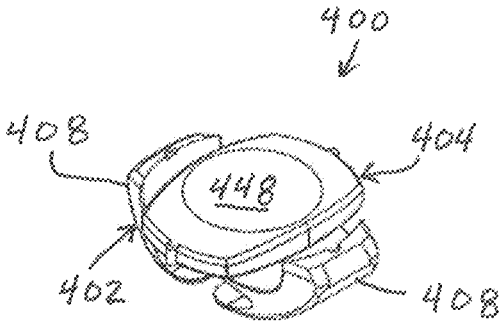
Figure 51:
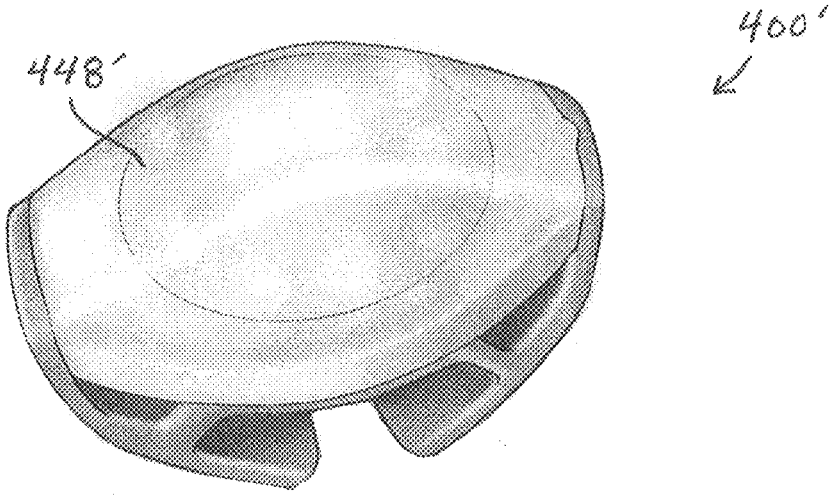
FIG. 51 is a perspective view of a first variation of the shoelace retainer of FIG. 44.
Figure 52:
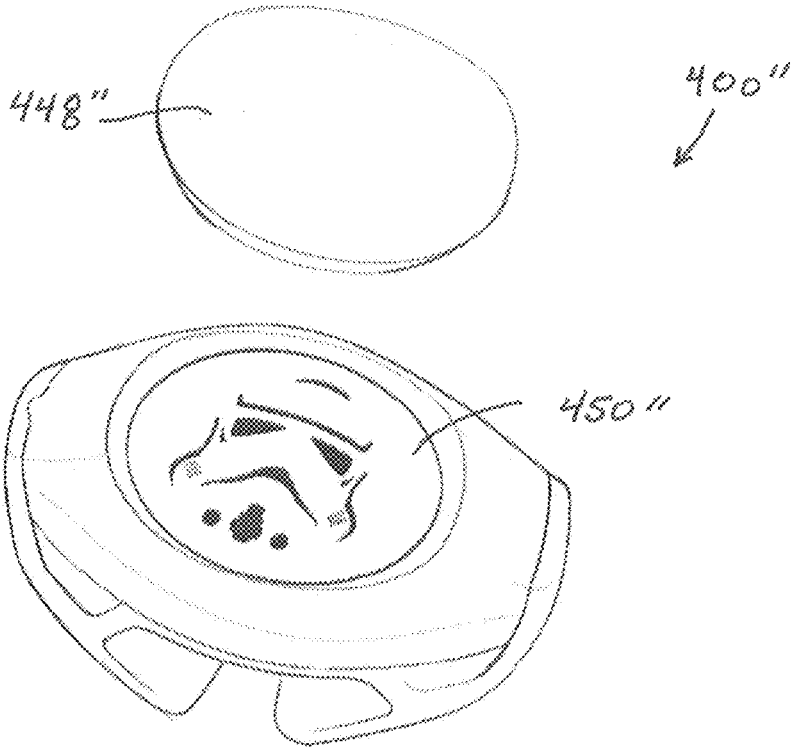
FIG. 52 is a perspective view of a second variation of the shoelace retainer of FIG. 44.

In this embodiment, however, the cap 404 of the shoelace retainer 400 includes an opening 446 and an insert 448 selectively positionable in the opening 446 (FIG. 48). When the insert 448 is positioned in the opening 446, an upper surface of the insert 448 is generally aligned with (e.g., is generally flush with, etc.) an upper surface of the cap 404. And, when the insert 448 is removed from the opening 446, an interior surface 450 of the opening 446 is exposed. In connection therewith, the interior surface 450 of the opening 446 may include one or more illumination features (e.g., light sources (e.g. light emitting diodes associated with a suitable power source such as a battery, etc.; etc.), whereby the insert 448 may be somewhat translucent to allow light to be emitted through the insert; etc.) such as illustrated in the shoelace retainer 400' of FIG. 51 (which includes an insert 448' having an illumination feature), one or more images such as illustrated in the shoelace retainer 400" of FIG. 52 (which includes an image on interior surface 450", generally below insert 448"), combinations thereof, etc. In addition, in other embodiments, the base 402 of the shoelace retainer 400 may alternatively, or additionally, include one or more illumination features.

While in the illustrated embodiment, the insert 448 and the opening 446 of the shoelace retainer 400 define a generally circular shape, it should be appreciated that the insert 448 and/or the opening 446 may have other shapes within the scope of the present disclosure (e.g., oval shapes, square shapes, rectangular shapes, star shapes, other shapes, etc.).

Figure 54:
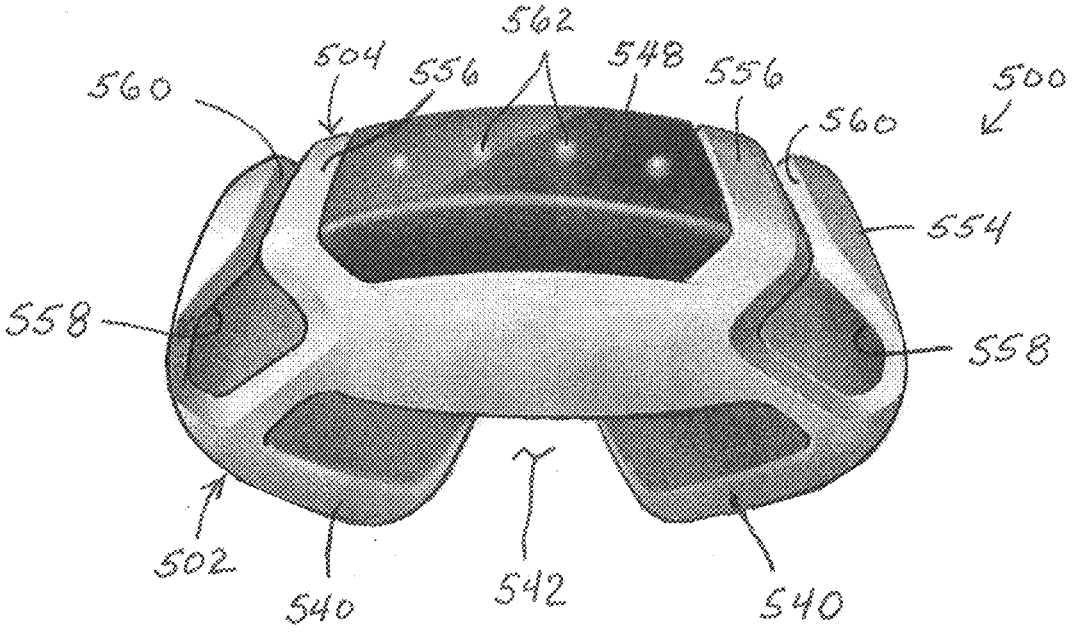
FIG. 54 is a perspective view of a further example embodiment of a shoelace retainer including one or more aspects of the present disclosure.
Figure 55:
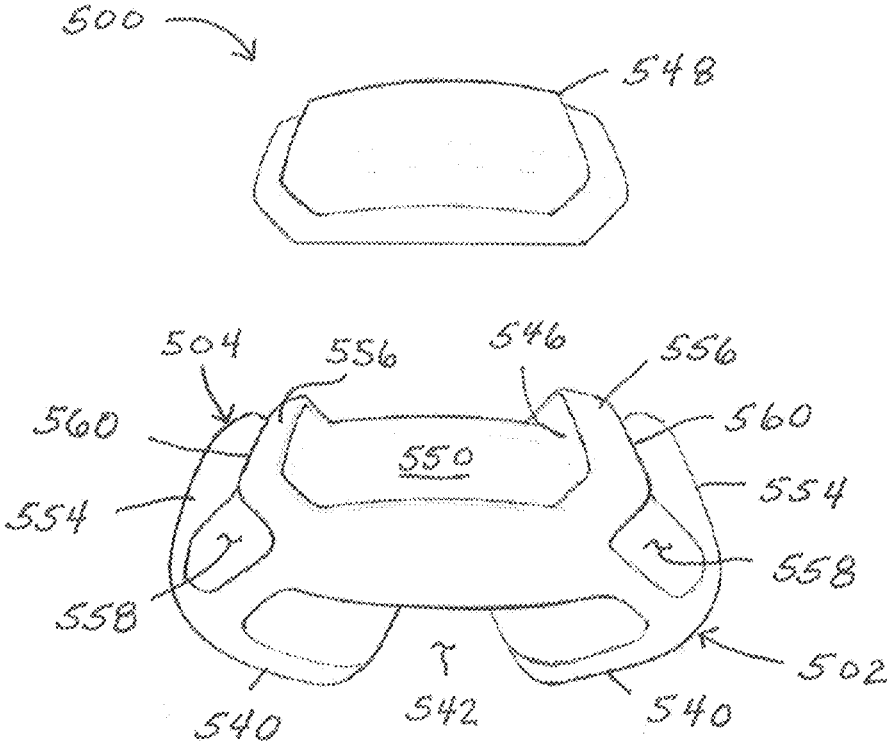
FIG. 55 is an exploded perspective view of the shoelace retainer of FIG. 54.
Figure 56:
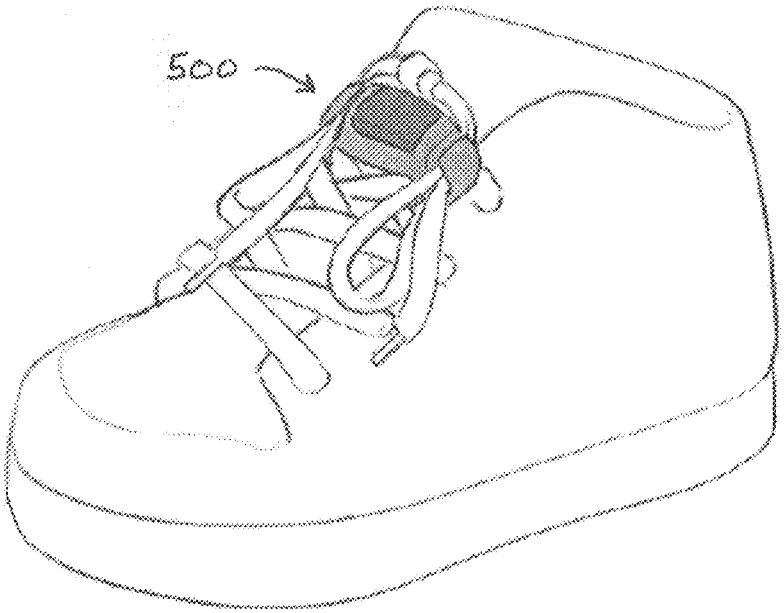
FIG. 56 is a perspective view of a shoe with the shoelace retainer of FIG. 54 shown coupled thereto.

FIGS. 54-56 illustrate a further example embodiment of a shoelace retainer 500 for use with a shoe and including one or more aspects of the present disclosure. Again, the shoelace retainer 500 is configured (e.g., sized, shaped, constructed, etc.) to couple to a shoe and then retain free ends of a shoelace threaded to the shoe (e.g., where the shoelace is already threaded to the shoe via eyelets of the shoe, etc.) to help inhibit the free ends from untying (e.g., to help inhibit a knot formed by the free ends of the shoelace from coming undone, etc.) (FIG. 56).

As shown in FIGS. 54 and 55, the shoelace retainer 500 is similar to the shoelace retainer 400 described above with reference to FIGS. 44-53 (e.g., may be installed to a shoe and used therewith in the same manner, etc.). For example, the shoelace retainer 500 includes a base 502 and a cap 504 coupled to the base 502. And, the base 502 includes first and second legs 540, and a spacing 542 defined between end portions of the legs 540, for use in coupling the shoelace retainer 500 to a shoe (thereby providing the pathways for receiving portions of a shoelace into the shoelace retainer 500 for coupling the shoelace retainer 500 to the shoe, in a similar manner to that described above).

In this embodiment, however, the cap 504 of the shoelace retainer includes two sets of opposing arms 554, 556 that define receptacles 558. As such, the receptacles 558, then, are configured to receive portions of a tied shoelace therein (e.g., end portions of the shoelace, bow portions of the shoelace, etc.), via a spacing 560 defined between the opposing arms 554, 556, to help inhibit the shoelace from inadvertently untying. In connection therewith, end portions of one or both of the opposing arms 554, 556 (of each of the sets) may be resiliently flexible to allow for positioning the desired portions of the shoelace therein, via the spacing 560.

Also in this embodiment, the cap 504 of the shoelace retainer 500 includes an opening 546 and an insert 548 having a generally rectangular shape. What's more, the insert 548 includes a light source 562 (e.g., one or more light emitting diodes associated with a suitable power source, etc.) configured to illuminate the insert 548 as desired (e.g., consistently, selectively via a switch (e.g., via a manual on/off switch, via a pressure sensitive switch such that the light source 562 activates when a shoe to which the shoelace retainer is installed contacts a surface, etc.). And, again, when the insert 548 is positioned in the opening 546, an upper surface of the insert 548 is generally aligned with (e.g., is generally flush with, etc.) an upper surface of the cap 504. Then, when the insert 548 is removed from the opening 546, an interior surface 550 of the opening 546 is exposed. In connection therewith, the interior surface 550 of the opening 546 may further include one or more additional illumination features (e.g., light sources (e.g. light emitting diodes, etc.), etc., whereby the insert 548 may be somewhat translucent to allow light to be emitted through the insert 548; etc.), one or more images, combinations thereof, etc.

It should be appreciated that the shoelace retainers of the present disclosure may have any desired dimensions. For example, and without limitation, shoelace retainers of the present disclosure may have overall height dimension of between about 0.4 inches and about 0.7 inches; overall longitudinal width dimensions (e.g., in a direction extending from arm to arm of bases of the shoelace retainers (or from wing to wing of the caps of the shoelace retainers), etc.) of between about 1.4 inches and about 1.8 inches; and overall transverse width dimensions (e.g., transverse to the longitudinal width dimensions, etc.) of between 0.8 inches and 1.2 inches.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

Example embodiments have been provided so that this disclosure will be thorough, and will fully convey the scope to those who are skilled in the art. Numerous specific details are set forth such as examples of specific components, assemblies, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, components, and/or groups thereof, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, seeds, members and/or sections, these elements, components, seeds, members and/or sections should not be limited by these terms. These terms may be only used to distinguish one element, component, seed, member or section from another element, component, seed, member or section. Terms such as "first," "second," and other numerical terms when used herein do not imply a sequence or order unless clearly indicated by the context. Thus, a first element, component, seed, member or section discussed below could be termed a second element, component, seed, member or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A shoelace retainer for use with a shoe, the shoelace retainer comprising:

a base defining at least one channel for receiving a first portion of a shoelace therein while the shoelace is coupled to a shoe, thereby coupling the shoelace retainer to the shoe; and a cap associated with the base and defining at least two receptacles relative to the base, the at least two receptacles configured to receive second portions of the shoelace when the base is coupled to the shoe;

wherein the cap is moveable relative to the base between an open position for receiving the second portions of the shoelace into the at least two receptacles and a closed position for retaining the second portions of the shoelace in the at least two receptacles; and wherein the cap is generally parallel to the base in the open position and in the closed position, and wherein the cap remains generally parallel to the base during movement of the cap between the open position and the closed position.

2. The shoelace retainer of claim 1, wherein the base includes a body and at least one arm extending away from the body; and wherein the cap is configured to couple to the body of the base such that the cap is moveable relative to the base between the open position and the closed position.

3. The shoelace retainer of claim 2, wherein the at least one channel extends through the body of the base.

4. The shoelace retainer of claim 2, wherein the at least one channel is disposed between the body of the base and a leg of the base.

5. The shoelace retainer of claim 2, wherein the at least one channel includes one channel.

6. The shoelace retainer of claim 2, wherein the cap defines at least one of the at least two receptacles relative to the at least one arm of the base.

7. The shoelace retainer of claim 2, wherein the at least one arm includes two arms, and wherein the body is disposed generally between the two arms.

8. The shoelace retainer of claim 7, wherein the cap includes a protrusion and wherein the body defines an opening generally between the two arms, and wherein the opening of the body is configured to receive the protrusion of the cap to pivotally couple the cap to the body.

9. The shoelace retainer of claim 1, wherein the at least one channel includes two channels.

10. The shoelace retainer of claim 1, wherein the at least two receptacles include two receptacles.

11. The shoelace retainer of claim 1, wherein the cap and/or the base includes at least one light source.

12. The shoelace retainer of claim 1, wherein the cap is releasably coupled to the base.

13. The shoelace retainer of claim 1, wherein the cap is integral with the base.

14. A shoelace retainer for use with a shoe, the shoelace retainer comprising:

a base having means for coupling the shoelace retainer to the shoe; and a cap associated with the base and defining means for retaining a portion of a shoelace of the shoe in the shoelace retainer when the base is coupled to the shoe;

wherein the means for retaining the shoelace in the shoelace retainer includes a receptacle formed between the cap and an arm of the base;

wherein the cap is moveable relative to the base between an open position for receiving the portion of the shoelace in the means for retaining the shoelace in the shoelace retainer and a closed position for retaining the portion of the shoelace in the means for retaining the shoelace in the shoelace retainer;

wherein the cap is generally parallel to the base in the open position and in the closed position; and wherein, in the open position, the cap covers at least part of the means for retaining the shoelace in the shoelace retainer.

15. The shoelace retainer of claim 14, wherein the cap includes a protrusion configured to pivotally couple the cap to the body.

16. The shoelace retainer of claim 14, wherein the means defined by the base includes a channel extending through the base and configured to receive another portion of the shoelace therein, to thereby couple the shoelace retainer to the shoe.

* * * * *